United States Patent [19]

Colombo

[11] Patent Number: 4,738,288

[45] Date of Patent: Apr. 19, 1988

[54] PRESSURE-FILLER SYSTEM

[75] Inventor: John W. Colombo, Castro Valley, Calif.

[73] Assignee: Atlas Pacific Engineering Company, Pueblo, Colo.

[21] Appl. No.: 904,505

[22] Filed: Sep. 8, 1986

Related U.S. Application Data

[63] Continuation-in-part of Ser. No. 834,958, Feb. 28, 1986, abandoned.

[51] Int. Cl.[4] ..... B65B 31/02

[52] U.S. Cl. ..... 141/61; 141/59

[58] Field of Search ..... 53/79, 266 R, 408, 432, 53/440, 467, 473, 474; 137/101.25, 101.27, 170.2, 205, 209, 210, 213; 141/1, 5, 6, 7, 44, 50, 57, 59, 61-63, 65, 82, 142, 145, 147, 148, 150; 222/252, 263, 397

[56] References Cited

U.S. PATENT DOCUMENTS

| | | | |
|---|---|---|---|
| 1,500,364 | 7/1924 | Calleson | 141/147 X |
| 1,709,577 | 4/1929 | Huntley | 137/170.2 X |
| 2,174,420 | 9/1939 | Kantor | 141/61 |
| 3,105,525 | 10/1963 | Boucher | 141/61 |
| 3,990,487 | 11/1976 | Loveland | 141/61 |
| 4,541,463 | 9/1985 | Rausing | 141/147 |

FOREIGN PATENT DOCUMENTS

| | | | |
|---|---|---|---|
| 945308 | 7/1956 | Fed. Rep. of Germany | 141/147 |

*Primary Examiner*—Mark J. Thronson

[57] ABSTRACT

The high speed syruper of this invention utilizes a combination of vacuum and pressure to fill cans with liquid. Steam is introduced into the cans prior to the application of a vacuum, and then the cans are filled with liquid under pressure, preferably in the range of 4 to 10 PSI.

The filling apparatus comprises a circular ring manifold mounted for rotation on a vertical axis. A rotary coupling fluidly connects the manifold to a pressurized source of liquid, and a plurality of cam operated valves control the flow of liquid from the manifold into the cans.

6 Claims, 5 Drawing Sheets

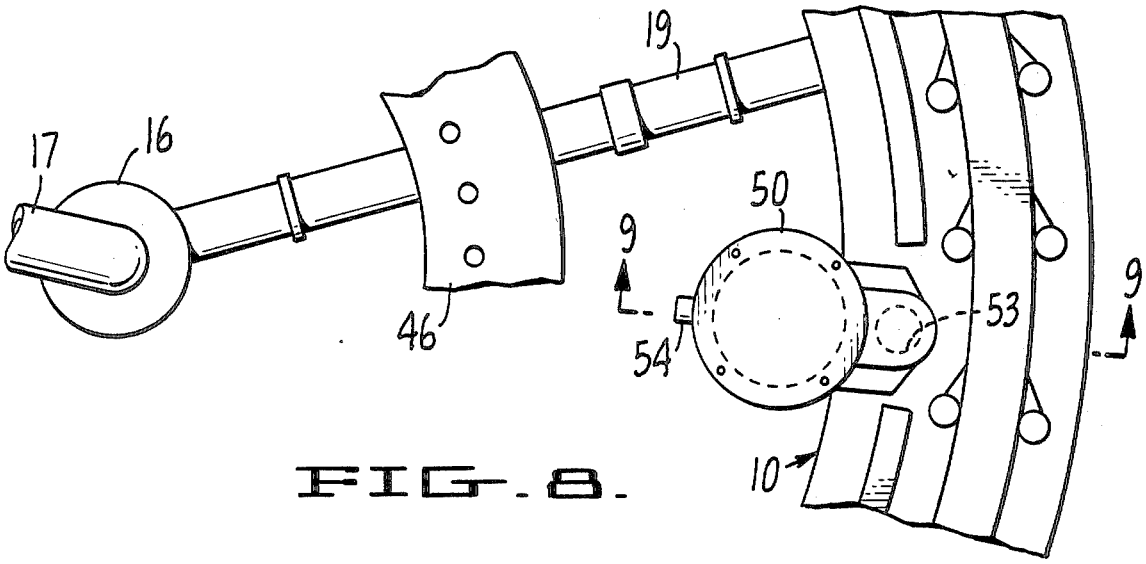
FIG. 8.
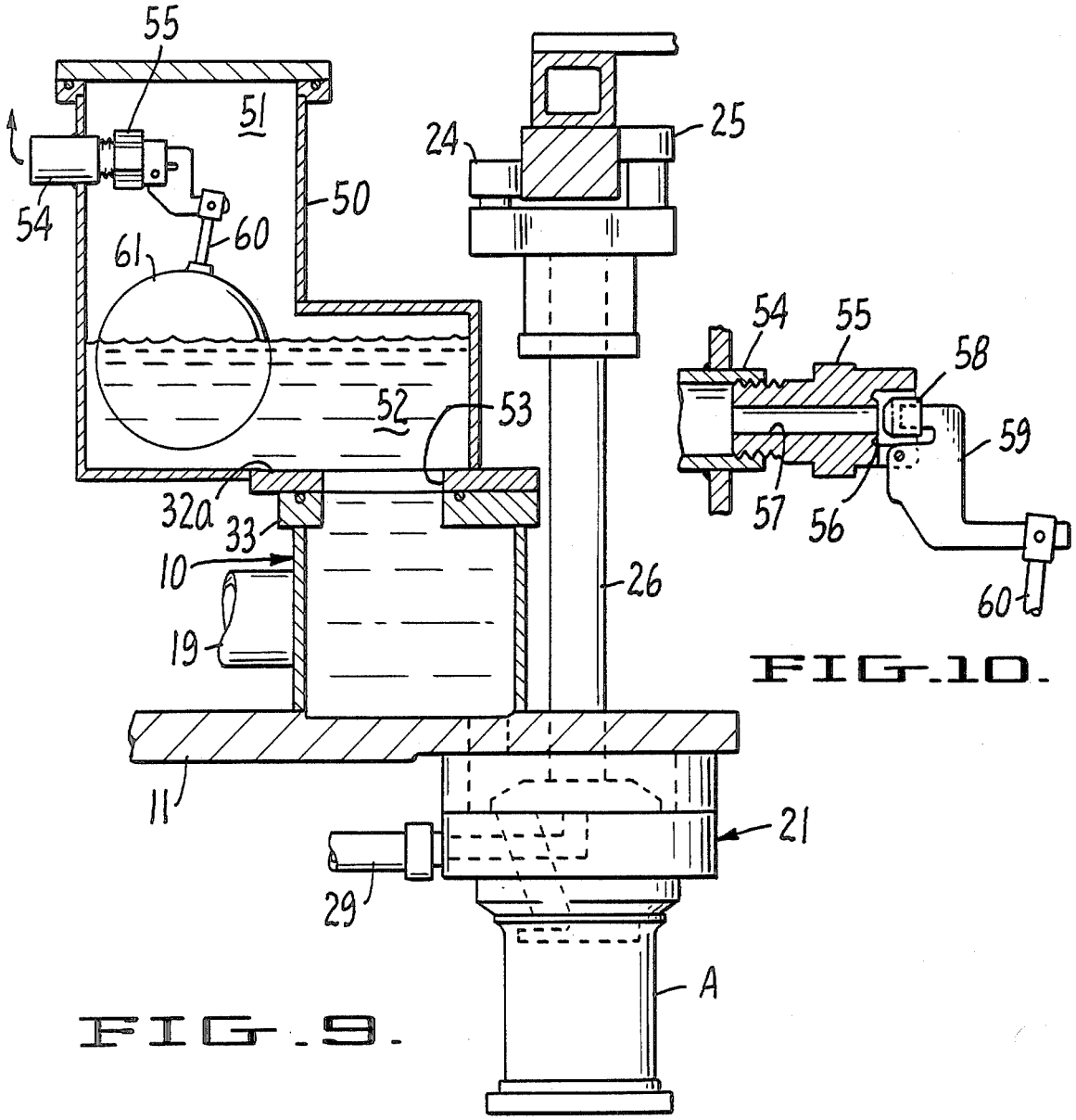
FIG. 10.
FIG. 9.

PRESSURE-FILLER SYSTEM

This application is a continuation-in-part of application Ser. No. 834,958, filed Feb. 28, 1986, now abandoned.

BACKGROUND OF THE INVENTION

This invention relates generally to vacuum syrupers and filling machines of the type shown in U.S. Pat. Nos. 2,543,788, 3,552,453, 3,990,487 and 4,532,971. The latter patent is particularly pertinent in its teaching of cam operated valves having a pair of cam followers for operating the valves, a structure that is also utilized in connection with the present invention.

This invention also relates to apparatus and methods for filling cans by discharging liquids under pressure into cans, such as disclosed in U.S. Pat. No. 1,365,773.

SUMMARY OF THE INVENTION

The high speed syruper of this invention is particularly useful in filling cans with high temperature liquids. Prior art syrupers normally operate by subjecting cans to a vacuum and then feeding liquid into the cans under gravity. When the liquid is fed into the cans at a high temperature (i.e. 165° F. and above) the liquid tends to flash and form a froth causing problems in filling the cans to capacity. The present invention provides means for force filling liquids into the cans under a pressure, preferably in the range of 4 to 10 PSI. When this is done in conjunction with first applying a vacuum pressure to the cans, it has been found that the cans may be filled to capacity with little or no frothing.

A further improvement of the present invention provides means for introducing steam into the cans immediately prior to applying a vacuum. Introducing the steam displaces the air and, any steam which remains in the cans will condense as a liquid, forming a better vacuum. This further step is particularly useful in filling cans with liquids where a lower vacuum is applied.

In general, the filling apparatus herein described comprises a circular ring manifold mounted for rotation on a vertical axis. A rotary coupling and conduits fluidly connect the manifold to a pressurized source of liquid, and a plurality of cam operated valves fluidly connect the manifold to cans which have been placed under a vacuum pressure.

In terms of method, the invention essentially comprises the steps of applying a vacuum pressure above each can; then, while maintaining a vacuum pressure in the cans, discharging a pressurized liquid into the can, said liquid being maintained under a pressure of 4 to 10 PSI. In preferred methods, the cans are initially filled with steam prior to placing the cans under a vacuum pressure or, alternatively, a head space is formed above the fill level of each can to receive and retain any froth that results from flashing.

A principal object of the present invention is, therefore, to provide methods and apparatus for handling high temperature liquids and filling cans to capacity. Other objects and advantages of the invention will become apparent in view of the following detailed description.

BRIEF DESCRIPTION OF THE DRAWINGS

In the drawings forming part of this application in which like parts are identified by like reference numerals.

FIG. 8 is a fragmentary plan view of a modification of the invention having means for purging gases from the manifold;

FIG. 9 is a vertical section on line 99 of FIG. 8; and

FIG. 10 is an enlarged section and partial elevation of a valve assembly shown in FIG. 9.

DESCRIPTION OF THE PREFERRED EMBODIMENT

Figure 1:
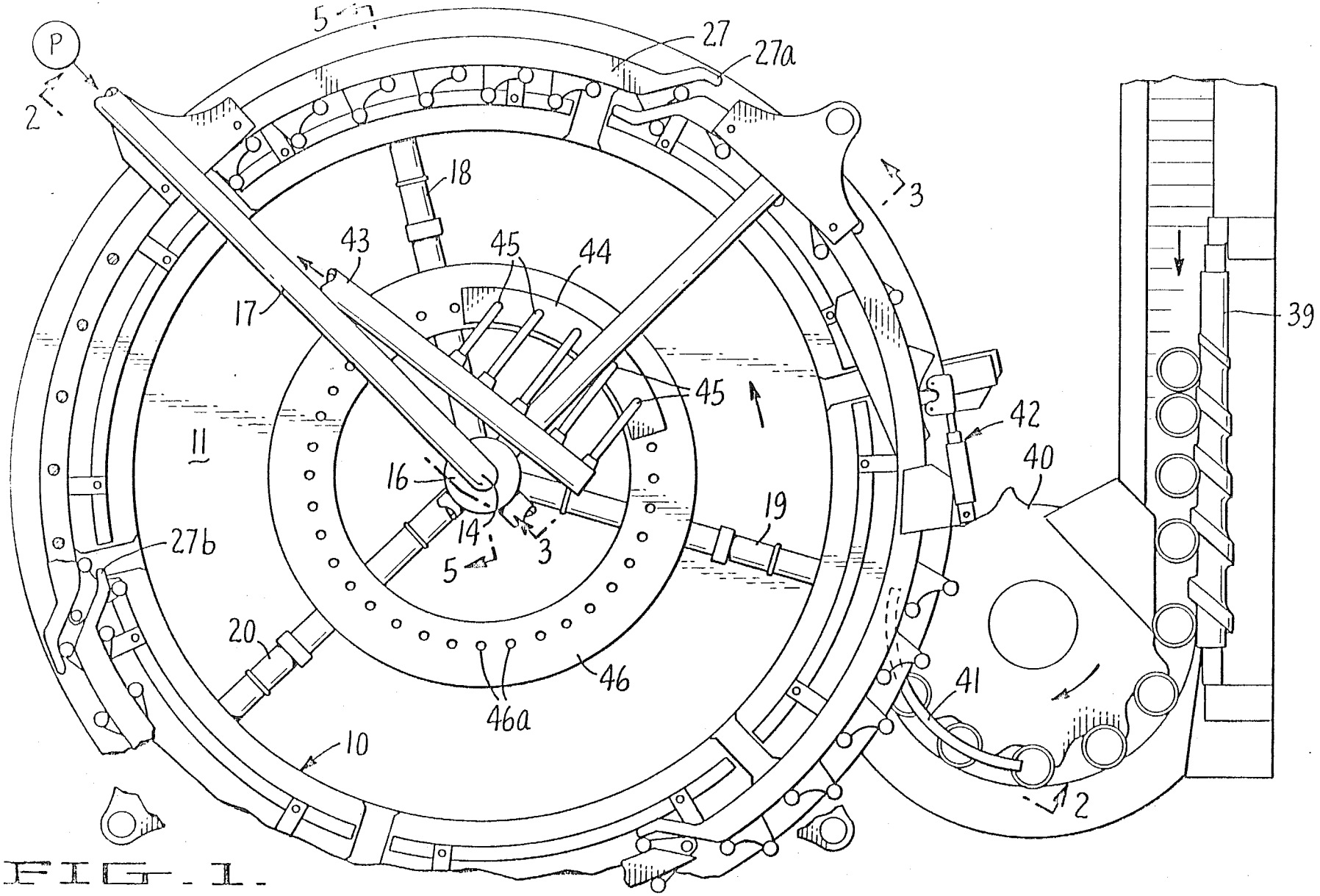
FIG. 1 is a plan view of a preferred embodiment of the invention.
Figure 2:
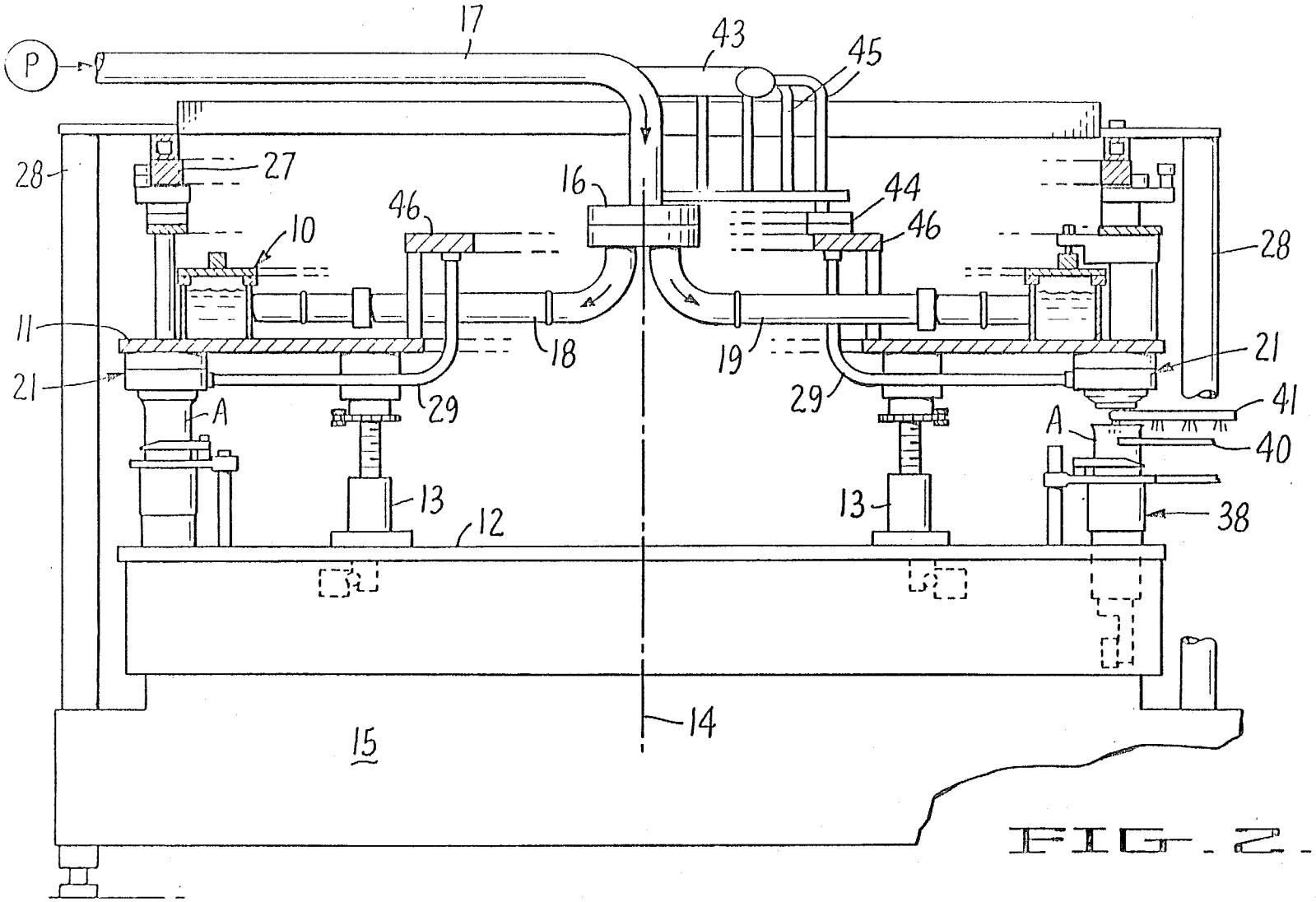
FIG. 2 is an elevation and partial section taken on lines 2—2 of FIG. 1.

Referring to FIGS. 1 and 2, there is shown a preferred embodiment of the invention in an apparatus for filling cans with liquid comprising a circular ring manifold 10 having a ring base plate 11 supported from a table 12 upon adjustable jacks 13. Table 12 is itself mounted for rotation about a vertical axis 14 from a bed 15.

Manifold 10 connects with a pressurized source of liquid (not shown) through a rotary coupling 16 and pressurized feed lines 17, 18, 19 and 20. Line 17 connects axially to the rotary coupling and radially outward to the pressurized source of fluid. Lines 18, 19 and 20 connect the coupling radially outward to the manifold. The connecting juncture of lines 18, 19, 20 to manifold 10 are spaced equal angular distances apart. Such an arrangement and the use of multiple feed lines provides an even distribution and flow of fluids to the manifold and avoids undesireable pressure drops.

Referring to FIGS. 3–7, a plurality of filler valves 21 are supported from plate 11 circumferentially of manifold 10. The valves are spaced equal angular distances apart, each valve 21 being operated in essentially the same manner as shown and described in U.S. Pat. No. 4,532,971. In that regard, each valve 21 comprises a valve body 22 having a pair of gated passages 22*a* and 22*b* that are selectively connected or disconnected by a pivoted valve disc 23. A pair of passages 23*a* and 23*b* formed in disc 23 cooperate with passages 22*a* and 22*b* in FIGS. 4 and 6. The movements of the valve disc are controlled by a pair of cam followers 24 and 25 mounted on the end of a valve stem 26. Cam followers 24 and 25 track the surfaces of a pair of horizontally displaced upper and lower cam tracks or caming surfaces provided on a cam 27 mounted from bed 15 on posts 28.

Figure 4:
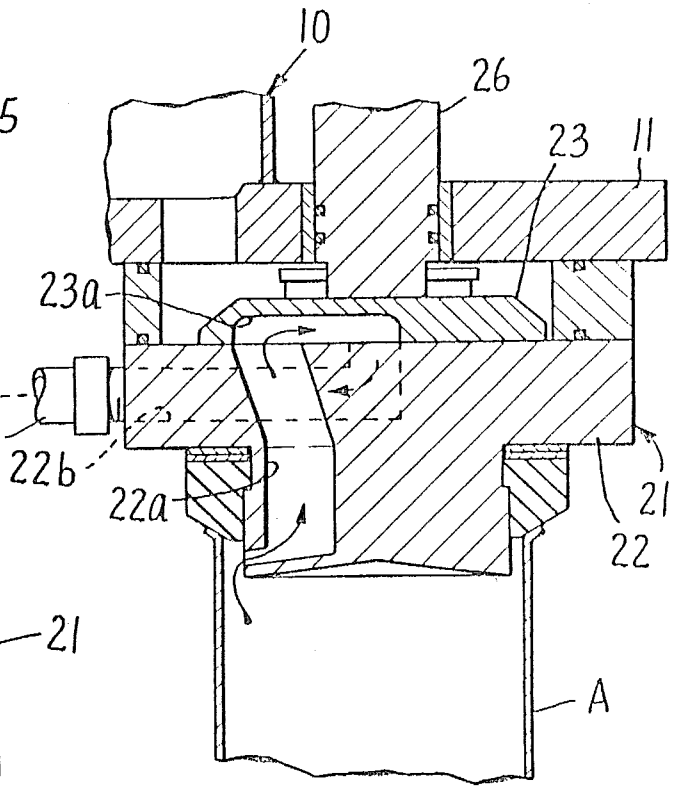
FIG. 4 is a vertical section through a filler valve having a rotatable valve disc positioned for applying a vacuum to a can.
Figure 3:
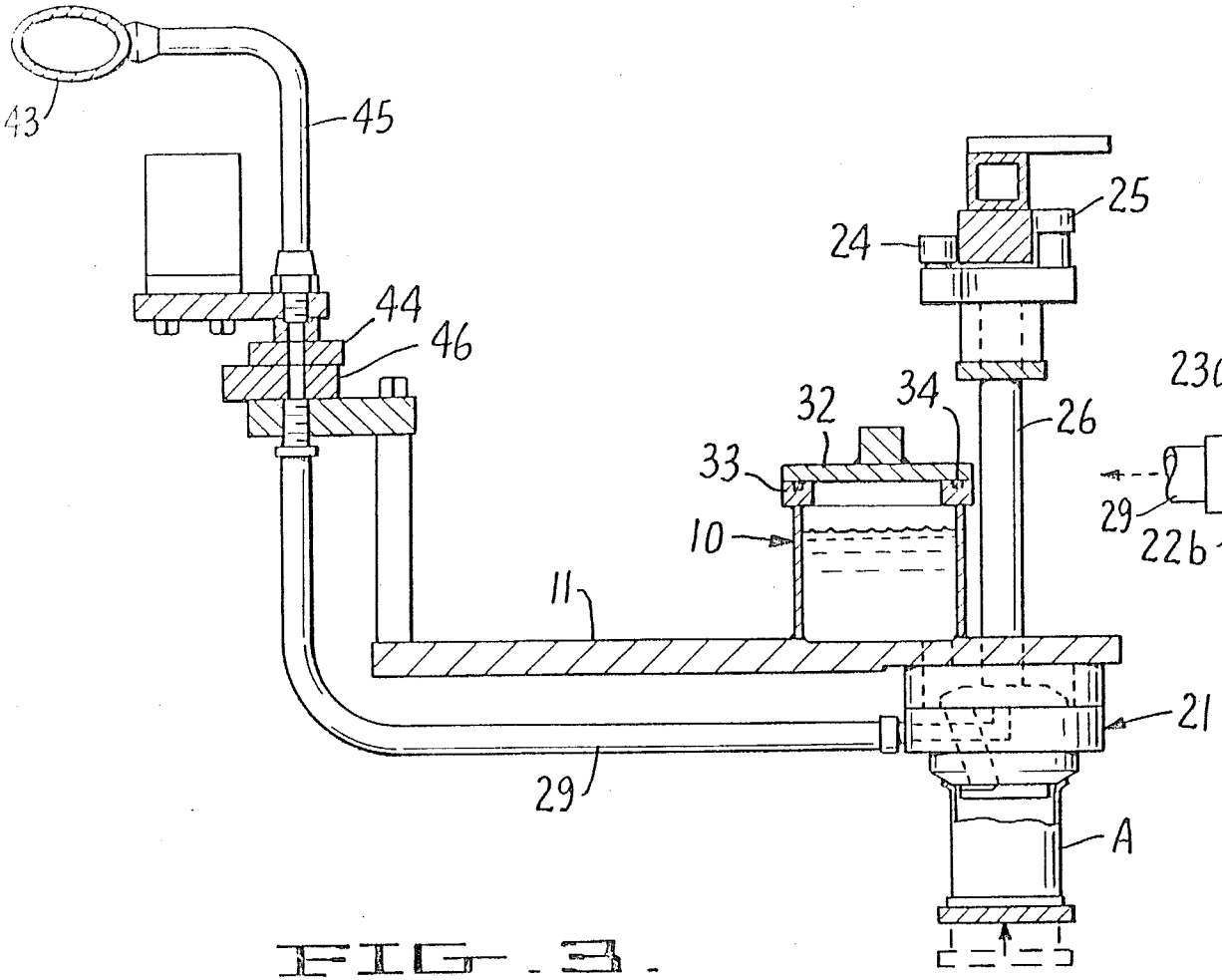
FIG. 3 is an elevation and partial section taken on lines 3—3 of FIG. 1.
Figure 6:
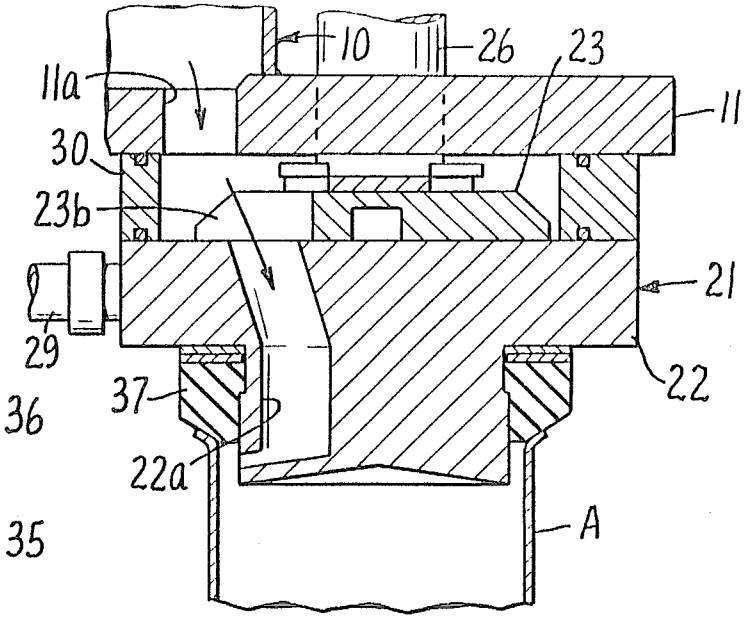
FIG. 6 is a vertical section through the filler valve, the valve disc being positioned for discharging pressurized liquid from the manifold into a can.

FIG. 4 illustrates the relative positions of the valve body and valve disc when the cans below the valve fluidly connect with either a vacuum pressure of a vent-to-atmosphere through passages 22*a* and 22*b* and a line 29. FIG. 6 illustrates the relative positions of the valve body and valve disc when the cans connect with manifold 10 through passage 22*a*, a stand-off ring 30 and a passage 11*a* formed in plate 11.

Figure 5:
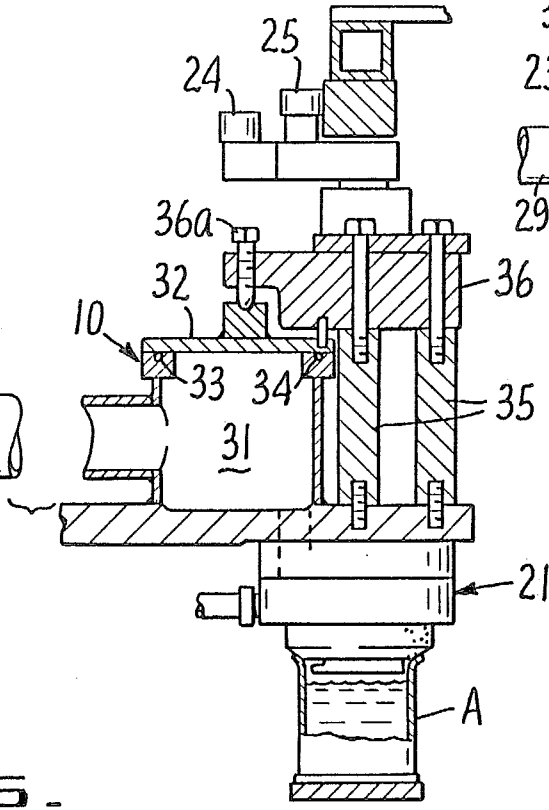
FIG. 5 is an elevation and partial section taken substantially on the lines of 5—5 of FIG. 1.
Figure 5:
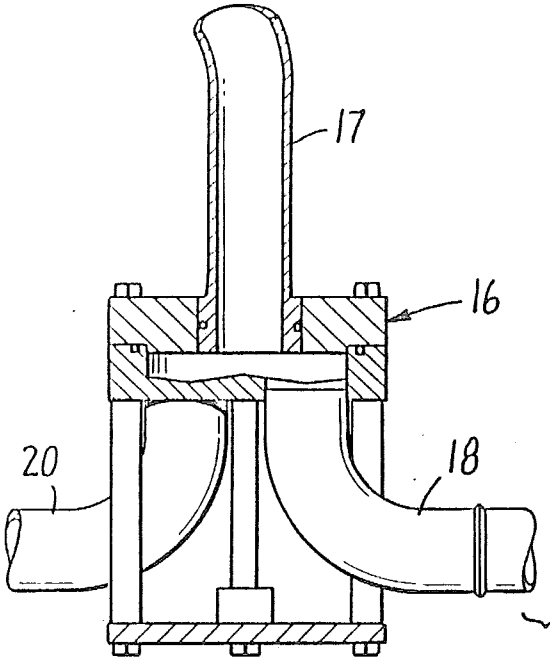

Manifold 10 essentially comprises a circular trough 31 having a substantially ring shaped cross section and a circular ring cover 32. A pair of circular seals 33 and 34 are provided between the trough and cover plate to form a pressure seal therewith. Means is also provided for releasably clamping the cover 32 over trough 31 to permit cleaning. As shown in FIG. 5, cover 32 is secured over the trough by means of hold-down clamps secured to ring plate 11. Each hold down clamp comprises a pair of posts 35, a clamping bar 36 mounted from posts 35 and a threaded bolt 36*a* that engages a seat on cover 32. Backing off, or unthreading bolts 36*a* allows cover 32 to be removed.

Cans A are fed sequentially into positions below each valve 21 and then elevated into sealing engagement with a seal ring 37 secured to the underside of each valve body. For this purpose a plurality of lift mechanisms, already known to the art and generally indicated as 38 are mounted upon rotating table 12. As shown in FIG. 1, empty cans A are fed onto lift mechanisms 38 in synchronized fashion by means of a timing screw 39 and a star wheel 40, each known in the art.

Means is also provided for filling the cans with steam as the cans leave the star wheel. For that purpose an arcuate steam line 41 is positioned directly above the open end of the cans as they are about to leave the star wheel. Filling the cans with steam displaces the air and this, it has been found, results in producing a better evacuation of the cans prior to filling with a liquid.

As with prior art devices, the illustrated embodiment of the invention utilizes a means for detecting the presence or absence of a can for filling; and, in the absence of a can, means is provided for moving cam followers 22 and 23 to a position where they cannot be operated in the normal fill cycle. A mechanism for accomplishing that function is indicated by the reference to No. 42 in FIG. 1. The operation of that mechanism is the same as that shown and described in U.S. Pat. No. 4,532,971.

The filling apparatus shown also provides means for applying a vacuum pressure to each can immediately prior to filling. For this purpose a vacuum line 43 connects to an arcuate vacuum shoe 44 through a plurality of connecting lines 45. A circular ring 46 mounted for rotation with table 13 and formed with a plurality of openings 46*a*, is supported directly under shoe 44, one opening 46*a* being connected to each valve 21 through a line 29. As ring 46 rotates openings 46*a* travel beneath shoe 44 and during this period of time a vacuum pressure is applied to the associated valve. However, the actual application of vacuum pressure to each can is controlled by manipulation of the valve disc under the control of cam followers 24 and 25 and their associated cam tracks.

Referring again to FIG. 1, the filling operation of each can A commences as the cam followers 24 and 25 arrive at point 27*a* on cam 27. The filling cycle continues, fluid being dispensed under pressure from manifold 10 through valve 21 as shown in FIG. 6, until the cam followers arrive at point 27*b* on cam 27. The valves 21 are then operated to vent the cans to atmosphere, as shown in FIG. 4; and the cans are removed from table 12.

Figure 7:
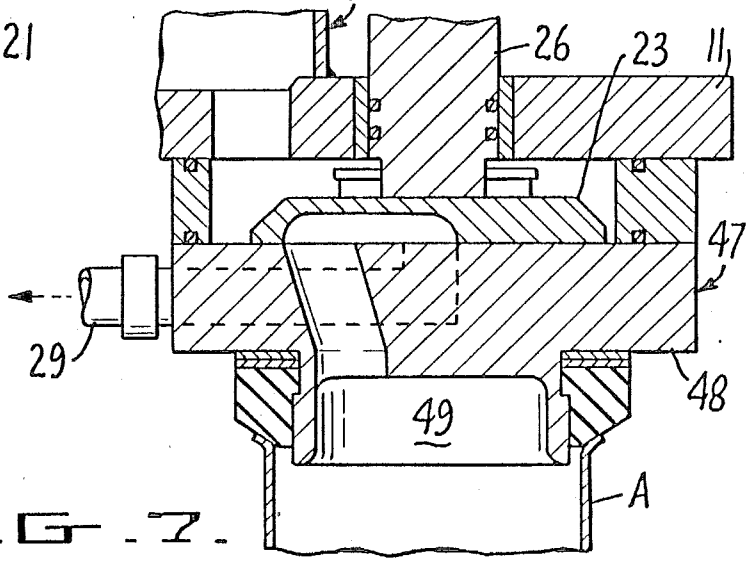
FIG. 7 is a vertical section through a filler valve that may be used as an alternative to that shown in FIGS. 4 and 6.

FIG. 7 illustrates an embodiment of valve construction 47 that may be used as an alternative to that shown in FIGS. 3–6. Valve 47 operates in the manner as shown in FIGS. 3–6, and it utilizes the same valve disc 23. Valve body 48, however, provides a head space 49 above the can as it is being filled. This permits a certain amount of frothing above the intended fill level, and the headspace receives and retains any excess froth that may result from flashing.

FIGS. 8, 9, and 10 illustrate a modification in apparatus that provides means for purging gases from manifold 10. Although cans A are placed under vacuum prior to filling, a certain amount of air and other gases remain during the filing operation. Those gases tend to escape into manifold 10 and, after a period of time, the manifold becomes filled with gases rather than liquid. The modification, therefore, provides a housing 50 having a float chamber 51 and a lower off set chamber 52 that fluidly connect with manifold 10 through an opening 53 formed in a modified cover 32*a*. A sleeve 54 is mounted to housing 50 at the upper end of chamber 51 and a valve body 55 threadably connects therewith within chamber 51. Valve body 55 provides a valve seat 56 at the end of a valve passage 57, and a plug 58 mounted to a lever 59 provides means for closing off passage 57. Lever 59 is pivotally mounted to valve body 55 and pivotally connects to a stem 60 which supports a float 61.

The foregoing device provides means for purging gases from manifold 10 whenever the level of liquid in chamber 51 falls below the level necessary to support float 61 and maintain valve passage 57 closed. One or more of such devices can be provided around the manifold as may be needed.

Although a preferred embodiment of the invention has been illustrated and described, various modifications and changes may be resorted to without departing from the spirit of the invention of the scope of the appended claims, and each of such modifications and changes is contemplated.

What is claimed is:

1. A pressurized filler apparatus comprising a ring manifold for retaining a liquid that is to be filled into cans, said manifold comprising a pair of concentric inner and outer cylindrical walls and a bottom wall that defines a continuous circular trough, and further comprising a removable upper plate, a pair of circular seals interposed between said upper plate and said pair of concentric inner and outer cylindrical walls, respectively; means for releasably clamping said upper plate over said continuous circular trough and onto said pair of seals, thereby pressure sealing said ring manifold;

means for rotatably mounting said ring manifold upon a vertical axis;

means including a rotary coupling for connecting said ring manifold to a stationary pressurized source of liquid, said coupling having a fixed coupling member and a rotating coupling member mounted upon said vertical axis, said connecting means further comprising conduits fluidly connecting said rotating coupling member to said circular trough;

means including a plurality of valves mounted to the bottom of said circular trough and having port openings for fluidly connecting the interior of said trough to a plurality of cans as the manifold rotates about said vertical axis;

and means for applying a vacuum pressure through each of said plurality of valves to evacuate the cans as the manifold and cans rotate about the vertical axis.

2. The apparatus of claim 1 and further comprising means for introducing and filling cans with steam immediately prior to applying a vacuum through said plurality of valves to the cans, thereby displacing air and allowing any steam which remains in the cans to condense as a liquid to form a better vacuum.

3. The apparatus of claim 1, each of said plurality of valves having a valve body and a can seal supported on an undersurface of said valve body for engaging the rim of a can, said valve body defining a head space above said can seal for receiving and containing froth or foamed liquid.

4. The apparatus of claim 3 and further comprising control means for operating said valves sequentially to connect the head space of said valves first to the vacuum pressure and then to said manifold.

5. The apparatus of claims 1 or 2 and further comprising means for purging gases from said manifold.

6. The apparatus of claims 1 or 2 and further comprising a housing having a float chamber fluidly connected to said manifold, and means for releasing gases collected in said float chamber including a float controlled valve disposed within said float chamber; whereby gases collected in said float chamber are purged therefrom whenever the float controlled valve is opened.

* * * * *